US009443652B2

(12) United States Patent
Yoon et al.

(10) Patent No.: US 9,443,652 B2
(45) Date of Patent: Sep. 13, 2016

(54) SOFT MAGNETIC CORE HAVING EXCELLENT HIGH-CURRENT DC BIAS CHARACTERISTICS AND CORE LOSS CHARACTERISTICS AND METHOD OF MANUFACTURING SAME

(71) Applicant: AMOGREENTECH CO., LTD., Gimpo-si (KR)

(72) Inventors: Se Joong Yoon, Gimpo-si (KR); Mi Rae Kim, Gimpo-si (KR)

(73) Assignee: AMOGREENTECH CO., LTD. (KR)

( * ) Notice: Subject to any disclaimer, the term of this patent is extended or adjusted under 35 U.S.C. 154(b) by 0 days.

(21) Appl. No.: 14/905,031

(22) PCT Filed: Jul. 16, 2014

(86) PCT No.: PCT/KR2014/006427
§ 371 (c)(1),
(2) Date: Jan. 14, 2016

(87) PCT Pub. No.: WO2015/009050
PCT Pub. Date: Jan. 22, 2015

(65) Prior Publication Data

US 2016/0155566 A1 Jun. 2, 2016

(30) Foreign Application Priority Data

Jul. 17, 2013 (KR) ..... 10-2013-0083942

(51) Int. Cl.
*H01F 27/24* (2006.01)
*H01F 41/02* (2006.01)
(Continued)

(52) U.S. Cl.
CPC ..... *H01F 41/0246* (2013.01); *B22F 1/0059* (2013.01); *B22F 3/02* (2013.01);
(Continued)

(58) Field of Classification Search
CPC .. H01F 5/00; H01F 27/00–27/30; H01F 1/03
USPC ..... 336/200, 83, 206–208, 233–234, 212; 148/100–106
See application file for complete search history.

(56) References Cited

U.S. PATENT DOCUMENTS 7,964,043 B2 * 6/2011 Petzold ..... C21D 9/00 148/121
2007/0175545 A1 * 8/2007 Urata ..... B22F 9/002 148/304

(Continued)

FOREIGN PATENT DOCUMENTS

JP 2010034102 2/2010
KR 100531253 11/2005

(Continued)

OTHER PUBLICATIONS

International Search Report—PCT/KR2014/006427 dated Sep. 4, 2014.

*Primary Examiner* — Tuyen Nguyen
(74) *Attorney, Agent, or Firm* — Cantor Colburn LLP

(57) ABSTRACT

Provided are a soft magnetic core having an excellent high current DC biased characteristic and an excellent core loss characteristic and a manufacturing method thereof. The method includes the steps of: after classifying nanocrystalline grains obtained by grinding metal ribbons prepared by using a rapid solidification process (RSP), mixing alloy powders so that a particle size distribution is configured to have a particle size of 75~100 μm with 10~85 wt %, a particle size of 50~75 μm with 10~70 wt %, and a particle size 5~50 μm with 5~20 wt %, to thus prepare the soft magnetic cores by using nanocrystalline alloy powders having an excellent high current DC biased characteristic and an excellent core loss characteristic.

6 Claims, 3 Drawing Sheets

(51) Int. Cl.

| | |
|---|---|
| ***H01F 5/00*** | (2006.01) |
| ***H01F 1/26*** | (2006.01) |
| ***H01F 1/153*** | (2006.01) |
| ***H01F 3/08*** | (2006.01) |
| ***B22F 1/00*** | (2006.01) |
| ***B22F 3/02*** | (2006.01) |
| ***B22F 9/04*** | (2006.01) |
| ***C21D 1/74*** | (2006.01) |
| ***C22C 38/00*** | (2006.01) |
| ***C22C 38/02*** | (2006.01) |
| ***C22C 38/12*** | (2006.01) |
| ***C22C 38/16*** | (2006.01) |
| ***C23C 26/00*** | (2006.01) |
| ***H01F 1/147*** | (2006.01) |

(52) U.S. Cl.

CPC ..... *B22F 9/04* (2013.01); *C21D 1/74* (2013.01); *C22C 38/002* (2013.01); *C22C 38/02* (2013.01); *C22C 38/12* (2013.01); *C22C 38/16* (2013.01); *C23C 26/00* (2013.01); *H01F 1/14741* (2013.01); *H01F 1/15333* (2013.01); *H01F 1/26* (2013.01); *H01F 3/08* (2013.01); *H01F 5/00* (2013.01); *B22F 2009/048* (2013.01); *B22F 2301/35* (2013.01)

(56) References Cited

U.S. PATENT DOCUMENTS

| | | | | |
|---|---|---|---|---|
| 2008/0078474 | A1* | 4/2008 | Naito | C22C 33/0207 148/304 |
| 2011/0227679 | A1* | 9/2011 | Koeda | B22F 1/0003 335/297 |
| 2015/0357118 | A1* | 12/2015 | Lee | B22F 1/0014 148/104 |
| 2016/0071637 | A1* | 3/2016 | Inagaki | H01F 27/255 336/234 |

FOREIGN PATENT DOCUMENTS

| | | |
|---|---|---|
| KR | 100545849 | 1/2006 |
| KR | 101385756 | 4/2014 |

* cited by examiner

SOFT MAGNETIC CORE HAVING EXCELLENT HIGH-CURRENT DC BIAS CHARACTERISTICS AND CORE LOSS CHARACTERISTICS AND METHOD OF MANUFACTURING SAME

TECHNICAL FIELD

The present invention relates to a soft magnetic core and a manufacturing method thereof, and more particularly to, a soft magnetic core having an excellent high current DC biased characteristic and an excellent core loss characteristic and a manufacturing method thereof.

BACKGROUND ART

In general, conventional Fe-based amorphous soft magnetic materials that are used as soft magnetic materials for high frequencies, have a high saturation magnetic flux density (Bs), but have low magnetic permeability, large magnetostriction, and bad high-frequency characteristics. Co-based amorphous soft magnetic materials have disadvantages of a low saturation magnetic flux density and a high price.

In addition, amorphous soft magnetic alloys have the difficulty when being processed into a strip-like shape, and have restrictions when being machined into a shape of a product such as a toroidal shape. Ferrite soft magnetic materials have a small quantity of high-frequency losses, but have a small saturation magnetic flux density, to thus make it difficult to achieve downsizing. Both the amorphous soft magnetic materials and the ferrite soft magnetic materials have a problem in poor reliability in view of heat stability due to a low crystallization temperature.

At present, soft magnetic cores are made by winding amorphous ribbons made by a rapid solidification process (RSP). In this case, the DC (direct-current)biased characteristic and high-frequency permeability of the soft magnetic cores are remarkably low, and the core losses thereof are also relatively large. The reason is that,in the case of powder core products, air gaps between powders are uniformly distributed, but, in the case of wound-type cores, air gaps do not exist in ribbons. Powder cores in the inside of which air gaps are present are suitable in order to make cores of the excellent high-frequency magnetic permeability and core loss.

Meanwhile, the soft magnetic cores for use in a suppression control of electromagnetic noise or as smoothing choke coils have been usually prepared by coating ceramic insulators on metal magnetic powders such as pure iron, Fe—Si—Al alloys (hereinafter referred to as "Sendust"), Ni—Fe—Mo-based permalloys (hereinafter referred to as "MPP (Moly Permally Powder)"), Ni—Fe-based permalloys (hereinafter referred to as"High-Flux)"), Fe-based amorphous powder cores, or nanocrystalline powder cores, adding a forming lubricant to the coated metal magnetic powders,and performing pressing, molding and heat treating in sequence.

Conventionally, insulating layers are formed between powders when manufacturing the above-described soft magnetic cores to thereby uniformly distribute air-gaps to thus minimize an eddy current loss that increases sharply in high-frequency environments, and exhibit good DC biased characteristics in the high current environments. For example, the pure iron powder cores are used for the suppression of electromagnetic noise due to super imposition in the high-frequency current in choke coils of a switching mode power supply (SMPS) of a switching frequency of 50 kHz or less, and the Sendust cores are used for secondary-side smoothing choke coil cores and noise suppression cores of a switching mode power supply (SMPS) of a switching frequency of a range of 100 kHz 1 MHz. Here, the "DC biased characteristics" are the characteristics of the magnetic cores with respect to waveform that is obtained when a direct-current is superimposed on a weak alternating-current generated in a process of converting an alternating current input of a power supply into a direct-current. When a direct-current is typically superimposed on an alternating-current, the magnetic permeability of cores falls in proportion to the direct-current. In this case, the "DC biased characteristics" are evaluated by a ratio (%; percent permeability) of the magnetic permeability at DC bias for the magnetic permeability of the non-overlapping DC.

MPP and High Flux cores are also used in the same frequency range as that of the Sendust cores and have more excellent DC biased characteristics and lower core loss characteristics than those of the Sendust cores but have a disadvantage such as an expensive price. Yet there is a need for development of cores of a degree equivalent to those of MPP and High Flux, with still an affordable price.

Meanwhile, the soft magnetic cores for use in such applications have required more difficult characteristics in accordance with the tendency of the miniaturization, integration, and high reliability of the switching mode power supply. Accordingly, the conventional metal powder cores have been used only at a frequency of 1 MHz or less, but have been limitedly used at the high-frequency band of 1 MHz or more.

In this respect,the present applicant has considered a problem in conventional soft-magnetic cores may be supplemented when preparing soft magnetic cores by using nanocrystalline powders with very excellent high-frequency and core loss characteristics, and smoothing choke coil cores of a switching mode power supply (SMPS) have required appropriate inductance (L), a low core loss and excellent DC biased characteristics, and thus has proposed a method of manufacturing a nanocrystalline soft magnetic core in Korean Patent Registration No. 10-0531253, to meet this need.

The Korean Patent Registration No. 10-0531253 discloses a method of manufacturing a nanocrystalline soft magnetic core using a powder mixture to adjust a particle size distribution of powders so as to have a powder of passing through a −100~+140 mesh (107~140 μm) of 15 to 65 wt %, and a powder of passing through −140~+200 mesh (74~107 μm) of 35 to 85 wt %.

However, in the case of the particle size distribution employed in the Korean Patent Registration No. 10-0531253, the powder of the large size of 100 μm or slightly larger has occupied a high proportion so that the sizes of the gaps between the powders are excessively increased. In particular, when considering that plastic deformation does not substantially made by a molding pressure in molding in the case of amorphous powders (most nanocrystalline particles also have the amorphous phase before a thermal treatment process.), the size of this gap in the molding process is not substantially reduced, and as a result this may act as a limit to improve the DC biased characteristics. In addition, when the air gaps between the powders are excessive, the strength of molded products is reduced to thereby have an adverse effect on the handling and workability of the products.

Another problem with the Korean Patent Registration No. 10-0531253 maybe caused by the fact that the core loss increases as a whole since the eddy current loss increases when the particle size of the powder increases (see <Table 1> in Korean Patent Registration No. 10-0545849).

Meanwhile, in the case that the fine powders whose sizes are very small have a relatively high proportion, it is not desirable because of a problem that the hysteresis loss increases. In general, the core loss may be divided into a hysteresis loss and an eddy current loss, in which the hysteresis loss represents a loss of as many as an area of a hysteresis loop, and the eddy current loss indicates the power loss due to eddy currents caused by the induced electromotive force. The eddy current loss is represented by the following Equation.

$$P_{e(eddycurrent\ loss)} = \frac{1.64d^2 f^2 B_m^2}{\rho} \quad \text{Equation}$$

Here, B=magnetic flux density (Flux Density), f=frequency, d=thickness, and p=resistivity (mΩ-m).

As shown in the Equation, it can be seen that the eddy current loss (Pe) is proportional to the square of thickness (diameter) of the particle inside the core. Thus, the overall decrease in the eddy current loss can be expected when reducing the particle size of the powder, but the hysteresis loss is increased due to reduction in the magnetic permeability and an increase in a coercive force (Hc) and thus the content of the fine powder of less than 50 μm should be limitedly used.

Moreover, the recent switching mode power supply (SMPS) industry has led by server personal computers (PCs), Telecom Power, etc., and major manufacturers are IBM, DELL, HP, etc. The design specifications of the power supply are also changed in accordance with the greater capacity, more advanced quality, and further slimming of PCs. First, the CPU specifications become oriented toward high frequency and large current, and a stable supply of power has been issued accordingly. Further, according to a multi-function of PCs, a capacity of the power supply increases, and thus a power factor correction (PFC) circuit is compulsorily employed. As a result, high performance PFC chokes require powder cores of large current stability, frequency stability, and low-loss to minimize an increase in volume in the power supply according to a further PFC circuit.

The present inventors have found that a molded density of a core molded body may increase, DC biased characteristics may be improved in a large current environment, and the core loss characteristics may be improved, by efficiently controlling and optimizing the particle size distribution of the powders constituting the soft magnetic cores, in the result of intensive studies about the method for manufacturing a Fe-based nanocrystalline soft magnetic core, in the background as described above, thereby completing the present invention.

In addition, in the case of amorphous metal powders, a reliability problem due to a large magnetostriction value has been known as a main disadvantage, but since cores made of nanocrystalline alloy powders have a small magnetostriction value close to "0," it has been recognized that noise and reliability problems may be solved.

Technical Problem

To solve the above problems or defects, it is an object of the present invention to provide soft magnetic cores to improve high current DC biased characteristics and core loss characteristics and a method of manufacturing the same, by mixing a mixed powder with a binder in which the mixed powder is obtained by combining Fe-based nanocrystalline alloy powders with sizes of three types so as to have a uniform air gap and a particle size distribution having an excellent moldability, and compression molding the mixed powder with the binder.

The objects of the present invention are not limited to the above-described objects, and other objects and advantages of the present invention can be appreciated by the following description and will be understood more clearly by embodiments of the present invention.

Technical Solution

To accomplish the above and other objects of the present invention, according to an aspect of the present invention, there is provided a method of manufacturing soft magnetic cores having an excellent high current DC biased characteristic and an excellent core loss characteristic, the method comprising the steps of: performing a preliminary heat treatment of Fe-based amorphous metal ribbons prepared by using a rapid solidification process (RSP) and nanocrystallizing the preliminarily heat treated Fe-based amorphous metal ribbons;obtaining alloy powders made of nanocrystalline grains obtained by grinding the metal ribbons; after classifying the alloy powders, mixing the alloy powders so that a particle size distribution is configured to have a particle size of 75~100 μm with 10~85 wt %, a particle size of 50~75 μm with 10~70 wt %, and a particle size 5~50 μm with 5~20 wt % to thereby obtain mixed powders;obtaining a core molded body by adding the mixed powderswith a binder and compression molding the mixed powders mixed with the binder; and performing an annealing treatment of the core molded body, and coating the annealing treated core molded body with an insulating resin, to thus prepare the soft magnetic cores.

Preferably but not necessarily, the binder comprises 0.5 to 3 wt % for the total weight of the mixed powder.

Preferably but not necessarily, the preliminary heat treatment is carried out at a temperature in a range of 300~600° C. for 0.2 hours to 1 hour.

Preferably but not necessarily, the annealing treatment is carried out at a temperature in a range of 400~600° C. for 0.2 hours to 1.5 hours in a nitrogen atmosphere.

According to another aspect of the present invention, there is provided a soft magnetic core having an excellent high current DC biased characteristic and an excellent core loss characteristic, the soft magnetic core comprising: a core formed by mixing Fe-based nanocrystalline alloy powders with a binder, and compression molding the Fe-based nanocrystalline alloy powders mixed with the binder, wherein the Fe-based nanocrystalline alloy powders are mixed powders obtained by mixing the alloy powders so that a particle size distribution is configured to have a particle size of 75~100 μm with 10~85 wt %, a particle size of 50~75 μm with 10~70 wt %, and a particle size 5~50 μm with 5~20 wt %.

Preferably but not necessarily, the soft magnetic core has a density of 82 to 84%, and a DC biased characteristic (%) is 51 or larger when a measured magnetization intensity is 100 Oe.

Advantageous Effects

As described above, the present invention prepares soft magnetic cores with nanocrystalline alloy powders obtained by using Fe-based amorphous metal ribbons as a starting material, exhibiting an excellent DC biased characteristic in a large current and a low core loss characteristic when compared with the conventional nanocrystalline soft magnetic core.

In the present invention, the soft magnetic cores are prepared by mixing nanocrystalline alloy powders so as to have a specific particle size distribution, and have an advantage that the soft magnetic cores can be widely utilized in operating conditions of the DC biased characteristic required in a severe high current as well as smoothing choke cores of a switching mode power supply (SMPS).

BEST MODE

Figure 1:
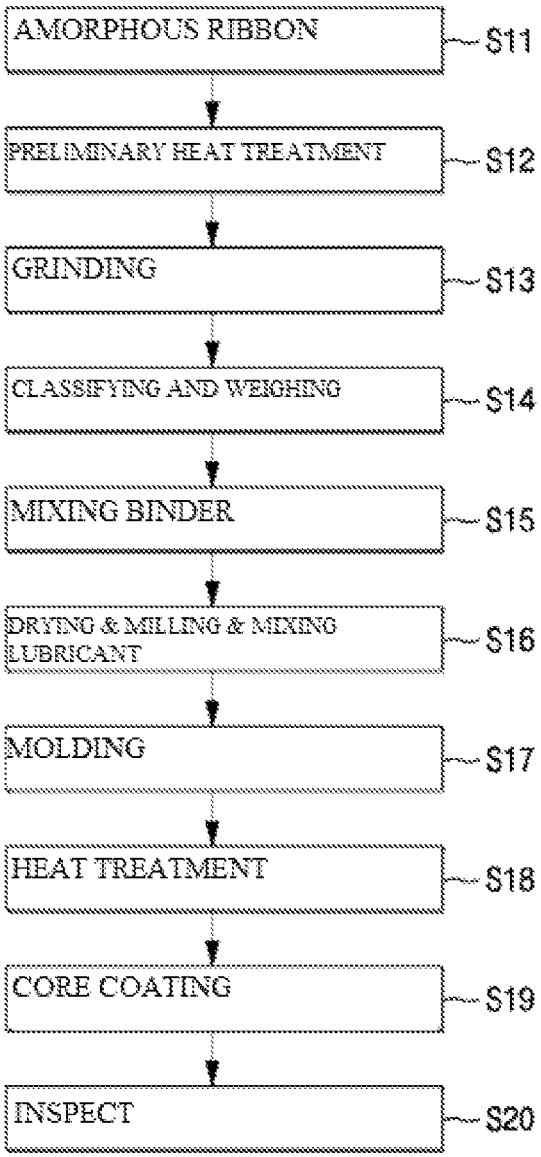
FIG. 1 is a flowchart view showing a schematic process of manufacturing soft magnetic cores by using nanocrystalline alloy powders according to an embodiment of the present invention.

Hereinafter, embodiments of the present invention will be described in detail with reference to the accompanying drawings. In the process, the size and shape of the components illustrated in the drawings may be shown exaggerated for convenience and clarity of explanation. Further, by considering the configuration and operation of the present invention the specifically defined terms can be changed according to user's or operator's intention, or the custom. Definitions of these terms herein need to be made based on the contents across the whole application.

A description will now be given on soft magnetic cores using Fe-based nanocrystalline alloy powders according to an embodiment of the present invention.

Soft magnetic cores according to an embodiment of the present invention have a structure that an insulating resin is coated on a surface of a molded product obtained by compression molding a mixture of powders that is obtained by mixing Fe-based nanocrystalline alloy powders with a binder of 0.5 to 3 wt % of the total weighthereof into a toroidal shape.

The Fe-based nanocrystalline alloy powders may be obtained by grinding thin-film ribbons made of Fe-based nanocrystalline alloys.

The Fe-based nanocrystalline alloys preferably use an alloy that satisfies the following Formula.

$$Fe_{100-c-d-e-f-g-h}A_cD_dE_eSi_fB_gZ_h \qquad \text{Formula}$$

In the above Formula, an element A is at least one element selected from Cu and Au, an element D is at least one element selected from Ti, Zr, Hf, V, Nb, Ta, Cr, Mo, W, Ni, Co, and rare earth elements, an element E is at least one element selected from Mn, Al, Ga, Ge, In, Sn, and platinum group elements, an element Z is at least one element selected from C, N, and P, c, d, e, f, g, and h are numbers that satisfy the following relational inequalities $0.01 \le c \le 8$ at %, $0.01 \le d \le 10$ at %, $0 \le e \le 10$ at %, $10 \le f \le 25$ at %, $3 \le g \le 12$ at %, $15 \le f+g+h \le 35$ at %, respectively, and the alloy structure of an area ratio of 20% or more is formed of the fine structure of the particle size of equal to or less than 50 nm in diameter.

In the aforementioned Formula, the element A is used to enhance corrosion resistance of the alloy, to prevent coarsening of crystal grains and at the same time, to improve the magnetic properties such as the iron loss and the permeability of the alloy. When the content of the element A is too small, it is difficult to obtain the effect of suppressing coarsening of crystal grains. Conversely, when the content of the element A is excessively large, the magnetic properties are degraded.

Thus, it is preferable that the content of the element A is in the range from 0.01 to 8 at %. The element D is an element that is effective for the uniformity of the crystal grain diameter, the reduction of magnetostriction, etc. It is preferable that the content of the element D is in the range from 0.01 to 10 at %.

The element E is an element that is effective for the soft magnetic properties of the alloy and improvement of corrosion resistance of the alloy. The content of the element E is preferably not more than 10 at %. The elements Si and B are elements that make the alloy become amorphous at the time of producing the magnetic sheet. It is preferable that the content of the element Si is in the range from 10 to 25 at %, and it is preferable that the content of the element B is in the range from 3 to 12 at %. In addition, it may include the element Z as an element that makes the alloy become amorphous, other than Si and B. In that case, the total content of the elements Si, B and Z is preferably in the range of 15 to 35 at %.

Further, for example, Fe—Si—B—Cu—Nb alloys may be used as the Fe-based nanocrystalline alloys, and in this case, it is preferable that the content of Fe is 73-80 at %, the content of the sum of Si and B is 15-26 at %, and the content of the sum of Cu and Nb is 1-5 at %. An amorphous alloy that is obtained by producing such a composition range in the form of a ribbon may be easily precipitated into nanocrystalline grains by a thermal treatment to be described later.

Fe-based nanocrystalline alloy powders used in the production of soft magnetic cores are obtained by making the Fe-based alloys into amorphous metal ribbons by a RSP (rapid solidification process) method, performing preliminary heat treatment of the amorphous metal ribbons, grinding the resulting nanocrystalline ribbons obtained through the preliminary heat treatment of the amorphous metal ribbons, to thus obtain powders, classifying the powders into powders having particle sizes of three types of 75~100 μm, 50~75 μm, and 5~50 μm, and combining the powders having particle sizes of three types.

A preferred particle size distribution of the nanocrystalline alloy powders used in some embodiments of the present invention includes 75~100 μm of 10~85 wt %, 50~75 μm of 10~70wt %, and 5~50 μm of 5~20 wt %. This is a particle size composition ratio to obtain optimal physical and magnetic properties of the soft magnetic core, to thereby obtain a core having a high molding density of a relative density of 82-84% during molding.

The reason for setting the particle size distribution as described above in the embodiment of the present invention will be described below in detail.

First, when using 75 to 100 μm powders exceeding 85 wt %, the eddy current loss increases to thus deteriorate core loss characteristics, and a density of a molded product is lowered to 82% or less, to thus make it difficult to expect to improve the DC biased characteristics. Meanwhile, when using 75 to 100 μm powders of less than 10 wt %, a desired permeability cannot be obtained.

When using 50 to 75 μm powders exceeding 70 wt %, the eddy current loss is reduced but a portion of the powders in the grinding process of ribbons is crystallized, to thus cause a hysteresis loss to increase to thus degrade overall core loss characteristics. Or, conversely, when using 50 to 75 μm powders of less than 10 wt %, the molded product density is lowered to thereby exhibit a marginal effect of improving the DC biased characteristics.

When using 5 to 50 μm powders of more than 20 wt %, the hysteresis loss increases to thus cause the core loss characteristics to fall significantly and fail to achieve a desired permeability. Conversely, when using 5 to 50 μm powders of less than 5 wt %, a small crack occurs on the core surface after molding, and the molded product density is lowered, to thereby fail to expect to improve the DC biased characteristics.

The soft magnetic core according to the embodiment of the present invention is configured by using a mixed powder obtained by mixing the Fe-based nanocrystalline alloy powder with a binder of 0.5 to 3 wt % of the total weight. In the case where the content of the binder is less than 0.5 wt %, the amount of an insulating material is insufficient and thus a high-frequency magnetic permeability becomes low (for example, at 10 MHz and 1V). Conversely, in the case where the content of the binder exceeds 3 wt %, the density of the nanocrystalline alloy powder is reduced due to an excessive addition of the insulating material, to thus cause a problem of dropping the permeability.

A method of manufacturing soft magnetic cores using Fe-based nanocrystalline alloy powders according to an embodiment of the present invention will be described below in detail.

FIG. 1 is a flowchart view showing a schematic process of manufacturing soft magnetic cores by using nanocrystalline alloy powders according to an embodiment of the present invention.

Referring to FIG. 1, first, ultra-thin amorphous ribbons of 30 μm thick, made of, for example, Fe—Si—B—Cu—Nb alloys as Fe-based amorphous ribbons are prepared by a rapid solidification process (RSP) due to melt spinning (S11). The amorphous metal ribbons are preliminarily heat treated for 0.2 hours to 1 hour at 300~600° C. in the atmosphere (S12).

When heat-treating the Fe-based amorphous ribbons, the heat treatment temperature is increased and thus nanocrystalline grains are generated from 300° C. The inductance value of the heat-treated amorphous ribbons is increased (the permeability is proportional to the inductance value) with increasing temperature. The inductance value of the ribbon is increased to the maximum at 580° C. to 600 ° C. Thereafter, when the Fe-based amorphous ribbons is overheated at temperature in excess of 580° C. to 600° C., the inductance value of the ribbon represents a value sharply decreasing in inverse proportion to the heat treatment temperature. The amorphous ribbons represent the maximum inductance value between 580° C. and 600° C. due to their individual variations.

The reason of setting the lower limit value of the preliminary heat treatment temperature to 300° C. is that when the preliminary heat treatment is performed at the heat treatment temperature of at least 300° C., it is possible to execute nanocrystallisation.

In addition, even when using powders whose nanocrystalline grains are not sufficiently formed, desired nanocrystalline grains are formed by a heat-treatment (annealing) process (S18) that is performed for 0.2 to 1.5 hours in a nitrogen atmosphere at 400~600° C. Formed after molding the core.

Then, when the preliminarily heat-treated nanocrystalline metal ribbons are ground with a grinder (S13), it is possible to obtain the nanocrystalline alloy powders. By selecting the appropriate rate and time during grinding, the powders having a variety of shapes and particle size ranges may be prepared. Then, the alloy powders obtained after the grinding process are classified into the powders having particle sizes in 75~100 μm, 50~75 μm, and 5~50 μm through a classifying process, and then are weighed to be combined in a desired particle size composition ratio (S14).

The particle size composition ratio of the nanocrystalline alloy powder with a preferred particle size distribution in the embodiment of the present invention, is configured to have the powders of the particle sizes in diameter of 75~100 μm of 10~85 wt %, 50~75 μm of 10~70 wt %, and 5~50 μm of 5~20 wt %. This is a particle sizecomposition ratio to obtain optimal physical and magnetic properties of the soft magnetic core, to thereby obtain a core having a high molding density of a relative density of 82-84% during molding.

In the case that a density of the molded core is less than 82%, cracks are generated on the core surface to thus cause a problem of degrading the DC biased characteristic and core loss characteristic of the core. It is preferable that the density of the molded core should get higher. As the content of the powder of the largest particle diameter of 75~100 μm is increased, the density of the molded core is increased. In this case, the DC biased characteristics are degraded, and a molding device is also strained. Thus, it is suitable to limit the density of the molded core to 84%.

Then in order to prepare the nanocrystalline alloy powders prepared as described above into a soft magnetic core,the nanocrystalline alloy powders are mixed with phenol, polyimide, or epoxy or a ceramic insulator such as a low-melting-point glass or water glass of 0.5 wt %~3 wt % compared to the total weight thereof, as a binder (S15), and dried. The drying process is to remove a solvent that is used to mix the nanocrystalline alloy powders with the binder.

The agglomerated powders after being dried are again ground to powders by following a milling process. After milling,any one lubricant selected from Zn, ZnS, a stearic acid, and a zinc-stearate (Zn-stearate) is added to and is mixed with the pulverized powders (S16), and then the mixed powders are molded in a molding pressure of about 20·26 ton/cm$^2$ by using a press, to thereby prepare a toroidal shape of cores (S17). The lubricant is used to reduce the friction between the powders or between the molded product and a mold, and for example, it is preferable to mix the pulverized powders with Zn-stearate of 2 wt % or less to the total weight thereof.

Next, the toroidal core having completed the molding is heat treated (or annealed) for 0.2 to 1.5 hours in a nitrogen atmosphere at 400~600° C. to thus remove residual stress and deformation (S18), and a polyester or epoxy resin is coated on the core surface (S19), in order to protect the core characteristics from moisture and air to thereby produce soft magnetic cores and inspect the various characteristics (S20). In this case, it is generally preferable that the thickness of the epoxy resin coating layer is 50~200 μm or so.

Hereinafter, a soft magnetic core and a manufacturing method thereof according to the embodiment of the present invention will be described in more detail with reference to the following examples. However, the following examples are nothing but illustrations of the invention, and are not limited to the scope of the invention.

EXAMPLE 1-4

An amorphous metal ribbon of a composition of $Fe_{735}Si_{13.5}B_9Nb_3Cu_1$ prepared by a rapid solidification process (RSP) was preliminarily heat-treated at 300° C. for 40 minutes under the atmospheric environment, to obtain an amorphous metal ribbon in which nanocrystalline grains were partially created. The thus-obtained amorphous metal ribbon was ground by using a grinder, to thus obtain nanocrystalline alloy powders. The thus-obtained alloy powders were classified to thus prepare mixed powders of Examples 1-4 to have the particle size distribution composition ratio shown in Table 1 according to the embodiment of the present invention.

The thus-obtained mixed powder was mixed with a waterglass of 2.0 wt %, which was subjected to drying. Dried agglomerated powder was pulverized again by using a ball mill, and then the zinc-stearate of 0.5 wt % was mixed with and added to the powder, and then was molded in a molding pressure of about 22 ton/cm$^2$ by using a core mold, to thereby prepare a toroidal shape of a core molded body.

Then, the core molded body was annealed at a temperature of 500° C. in a nitrogen atmosphere for 60 minutes, and then an epoxy resin of 100 μm thick was coated on the core molded body surface to thus have prepared the soft magnetic cores of Examples 1-4, to then have measured the permeability, molding density, the DC biased characteristics, and core loss characteristics, respectively, to then illustrate each of the measurement results in Table 1.

TABLE 1

Magnetic properties of the soft magnetic core according to Examples of the present invention

| | Example 1 | Example 2 | Example 3 | Example 4 |
|---|---|---|---|---|
| 75~100 μm (wt %) | 70 | 85 | 40 | 60 |
| 50~75 μm (wt %) | 20 | 10 | 50 | 20 |
| 5~50 μm (wt %) | 10 | 5 | 10 | 20 |
| Magnetic permeability (μ) | 60 | 60 | 60 | 60 |
| Molding density (%) | 84 | 83 | 83 | 83 |
| DC biased characteristics (%) | 53 | 51 | 53 | 52 |
| Core loss (mW/cm$^3$) | 400 | 420 | 450 | 430 |
| Surface cracks (yes, no) | x | x | x | x |

In Table 1, the permeability (μ) was obtained by the relationship of an annular core (for example, a toroidal core) ($L=(0.47\pi\mu N^2A\times10^{-2})/l$) (where, N is the number of turns, A is a core area, and l is an average magnetic path length), after having wound an enamel copper wire in coils by 30 times and having measured the inductance (L) by using a precision LCR meter, under the measurement conditions such as a frequency 100 kHz and an AC voltage of 1V, in a non-superposed DC state ($I_{DC}$=0 A).

Further, while changing the DC current,the change in magnetic permeability was measured to examine DC bias characteristics, under the measurement conditions such as 100 kHz, the AC voltage of 1V, a measured magnetization intensity of ($H_{DC}$) of 100 Oersted (which was calculated by substituting peak magnetization current (I) in the formula $H_{DC}$ (=0.47πNI/l)). The core loss (mW/cm$^3$) was measured in a BH analyzer, after having wound the primary and secondary windings by 30 times and 5 times, respectively.

From the results of Examples 1 to 4 of the present invention shown in Table 1, when manufacturing a soft magnetic core after limiting the particle size distribution of the nanocrystalline alloy powder to a specific range in the present invention, it can be seen that the improvement of the surface condition of the core, as well as the improvement of the DC biased characteristics and the reduction effect of the core loss could be obtained.

Meanwhile, in order to compare the soft magnetic core according to the present invention with a soft magnetic core according to a conventional material that was prepared by mixing a particle powder proposed in Korean Patent Registration No. 10-0531253 with the nanocrystalline alloy powder of the same alloy composition as those of the Examples of the present invention at a mixed ratio of a particle size of 100~150 μm of 40 wt % and a particle size of 75~100 μm of 60 wt %, the magnetic properties were measured under the same conditions as in the Examples of the present invention and the measurement results were shown in Table 2 below.

TABLE 2

Comparison of properties between the present invention and conventional material

| | Magnetic permeability (μ) (100 kHz, 1 V) | DC biased characteristics (%) (100 Oe) | Core loss (mW/cm$^3$) (100 kHz, 0.1 T) |
|---|---|---|---|
| Conventional material | 60 | 45 | 550 |
| Example 1 | 60 | 53 | 400 |
| Example 2 | 60 | 51 | 420 |
| Example 3 | 60 | 53 | 450 |
| Example 4 | 60 | 52 | 430 |

As shown in Table 2, it can be seen that DC biased characteristics and core loss characteristics of the soft magnetic core according to the embodiment of the present invention were significantly improved compared with the conventional material. That is, according to the embodiment of the present invention, the content of powders in a relatively small size was increased in the particle size distribution of the nanocrystalline alloy powder, and thus an insulation effect was increased by the binder of the powder surface, to thereby decrease the leakage flux. Further,since large pores formed between the powders were filled with an addition of fine powders, the large pores in the molded body were removed, and thus the fine pores are distributed uniformly to have obtained a result of improving the DC biased characteristics and the core loss characteristics due to reduction in the eddy current loss.

Figure 2:
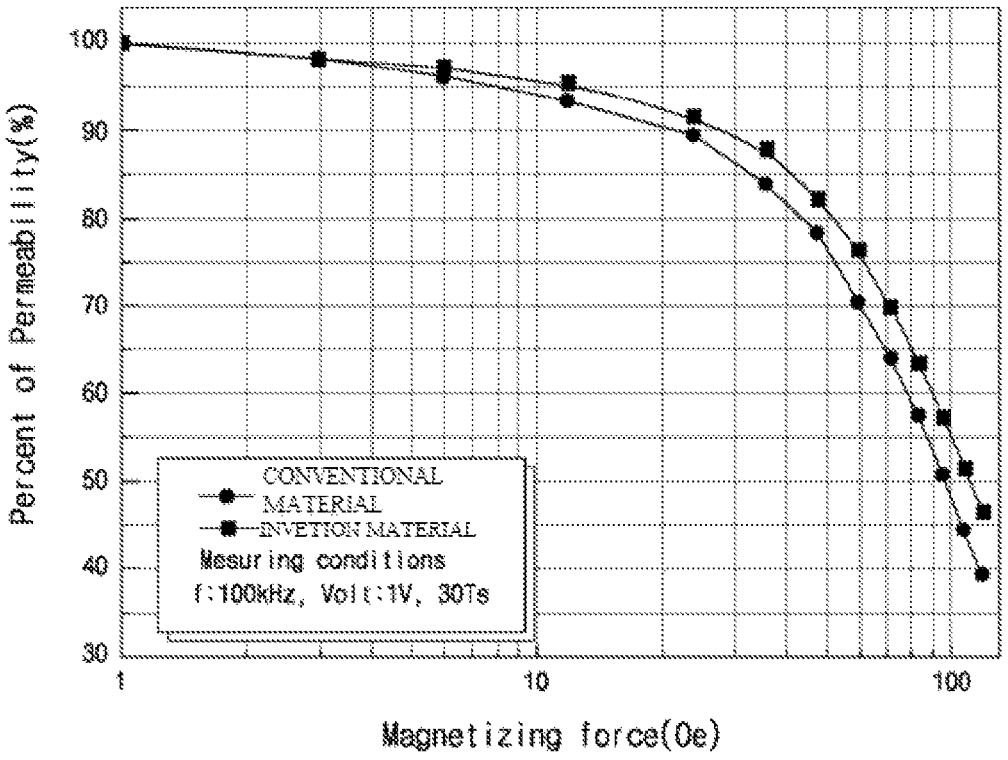
FIG. 2 is a graph showing a comparison of a change in DC bias characteristics of a soft magnetic core prepared in accordance with an embodiment of the present invention with that of a conventional material.

FIG. 2 is a graph showing respective changes in the magnetic permeability according to the DC bias at 100 kHz and 1V between Example 1 (an invention material) (■) of the present invention as set forth in Table 2 and the conventional material (●). As shown in FIG. 2, it can be seen that the soft magnetic core of Example 1 (invention material) made according to the present invention shows an excellent DC biased characteristic when compared to the conventional material. That is, it can be seen that the soft magnetic cores of Example 1 of the present invention represents an improved effect of 6~8% (100 Oe or so) in view of the DC biased characteristic through a change in the particle size distribution of the nanocrystalline alloy powder.

Figure 3:
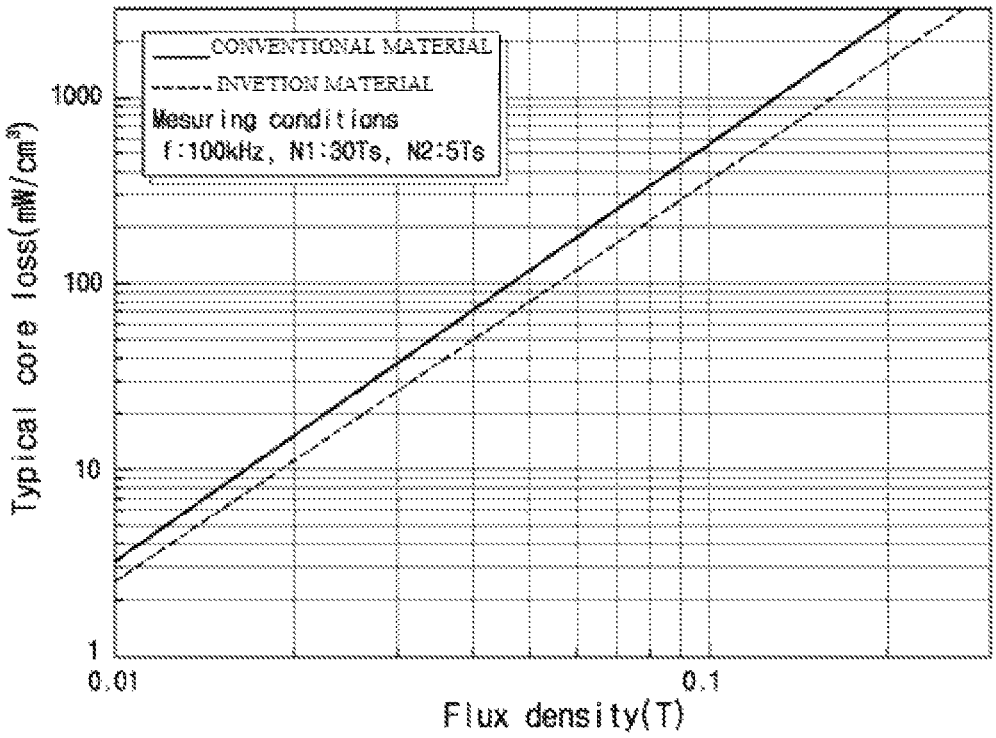
FIG. 3 is a graph showing a comparison of a core loss of,at 100 kHz, a soft magnetic core prepared in accordance with an embodiment of the present invention with that of a conventional material.

Also, from the graph of FIG. 3 showing the core loss at 100 kHz of the soft magnetic core according to the present invention with that of the conventional material, it can be seen that the invention material (Example 1) of the present invention also significantly improved the core loss characteristic (dotted line) when compared to that of the conventional material (solid line).

Meanwhile,in order to determine characteristic changes depending upon the particle size distribution of the powder mixture,characteristic changes were tested after the particle size distribution was configured to cause a departure from the scope of the invention.

COMPARATIVE EXAMPLE 1

Except that the particle size distribution of the nanocrystalline alloy powder was configured to have 75~100 μm of 90 wt %, 50~75 μm of 5 wt %, and 5~50 μm of 5 wt %, the soft magnetic core was prepared in the same manner as in Example 1.

COMPARATIVE EXAMPLE 2

Except that the particle size distribution of the nanocrystalline alloy powder was configured to have 75~100 μm of 5 wt %, 50~75 μm of 75 wt %, and 5~50 μm of 20 wt %, the soft magnetic core was prepared in the same manner as in Example 1.

COMPARATIVE EXAMPLE 3

Except that the particle size distribution of the nanocrystalline alloy powder was configured to have 75~100 μm of 20 wt %, 50~75 μm of 75 wt %, and 5~50 μm of 5 wt %, the soft magnetic core was prepared in the same manner as in Example 1.

COMPARATIVE EXAMPLE 4

Except that the particle size distribution of the nanocrystalline alloy powder was configured to have 75~100 μm of 80 wt %, 50~75 μm of 5 wt %, and 5~50 μm of 15 wt %, the soft magnetic core was prepared in the same manner as in Example 1.

COMPARATIVE EXAMPLE 5

Except that the particle size distribution of the nanocrystalline alloy powder was configured to have 75~100 μm of 60 wt %, 50~75 μm of 15 wt %, and 5~50 μm of 25 wt %, the soft magnetic core was prepared in the same manner as in Example 1.

COMPARATIVE EXAMPLE 6

Except that the particle size distribution of the nanocrystalline alloy powder was configured to have 75~100 μm of 60 wt %, 50~75 μm of 38 wt %, and 5~50 μm of 2 wt %, the soft magnetic core was prepared in the same manner as in Example 1.

The permeability, the DC biased characteristics, the core losses, and existence or non-existence of the surface cracks of the respective soft magnetic cores obtained in the Comparative Examples, were examined and thus the results of the Comparative Examples are shown in Table 3 together with the results of Example 1 below.

TABLE 3

Comparison of properties between the present invention and the Comparative Examples

| | Comparative Example 1 | Comparative Example 2 | Comparative Example 3 | Comparative Example 4 | Comparative Example 5 | Comparative Example 6 | Example 1 |
|---|---|---|---|---|---|---|---|
| 75~100 μm (%) | 90 | 5 | 20 | 80 | 60 | 60 | 70 |
| 50~75 μm (%) | 5 | 75 | 75 | 5 | 15 | 38 | 20 |
| 5~50 μm (%) | 5 | 20 | 5 | 15 | 25 | 2 | 10 |
| Magnetic permeability (μ) | 60 | 53 | 60 | 60 | 51 | 60 | 60 |
| Molding density (%) | 79 | 80 | 82 | 78 | 78 | 79 | 84 |
| DC biased characteristic (%) | 48 | 51 | 50 | 48 | 52 | 52 | 53 |
| Core loss ($mW/cm^3$) | 640 | 580 | 450 | 660 | 600 | 440 | 400 |
| Surface cracks (yes, no) | ○ | x | x | ○ | x | ○ | x |

From Table 3, in the case that the powder of the particle size of 50~75 μm is less than 10 wt %, or the powder of the particle size of 75~100 μm is more than 85 wt %, it can be seen that fine cracks may occur on the surface of the core molded body, the DC biased characteristics and core loss characteristics may be degraded, and an effect of improving the magnetic properties cannot be obtained through this.

In addition, in the case that the powder of the particle size 5~50 μm is more than 20 wt %, it can be seen that the molding density decreases in accordance with the filling property deterioration, a desired permeability cannot be achieved for this reason, and an effect of improving the DC biased characteristics is insignificant.

Specifically, as in Comparative Example 1, the powder of the particle size of 50~75 μm is more than 85 wt %, and the powder of the particle size of 75~100 μm is less than 5 wt %, that is, when the content of powders of the large particle size is high, it can be seen that fine cracks may occur on the surface of the core, the core loss characteristic is not improved, and the molding density is low, to thereby fail to achieve the improvement of the DC biased characteristics.

As in Comparative Example 2,in the case that the powder of the particle size of 75~100 μm is less than 10 wt %, and the powder of the particle size of 50~75 μm is more than 70 wt %,in opposition to Comparative Example 1, that is, when the content of powders of the large particle size is too low, the permeability was exhibited as 53 or so, which is about 12% lower than the permeability in Example 1 of the present invention. Thus, when the content of powders of the large particle size is less than a suitable amount, it can be seen that a desired permeability cannot be obtained. In addition, Comparative Example 2 exhibited a large core loss characteristic as the powder of the particle size of 50~75 μm that is the medium size is more than 70 wt %.

In addition, when only the powder of the particle size of 50~75 μm that is the medium size exceeds 70 wt %, as in Comparative Example 3, the permeability and core loss characteristics are satisfied to a certain extent, but it is difficult to substantially expect the improvement of the DC biased characteristics.

As in Comparative Example 4, in the case that the powder of the particle size of 50~75 μm that is the medium size is less than 10 wt %, in opposition to Comparative Example 3, a balance of the particle size distribution of the powder mixture is broken greatly. Therefore, fine cracks may occur on the surface of the core, during molding the core, and a low molding density of 78% may be obtained to thus cause both the DC biased characteristics and the core loss characteristics to be poor.

When the powders of the small particle size of 5~50 μm exceeds 20 wt % as in Comparative Example 5, the molding density decreases in accordance with reduction in the filling property and the particle size distribution balance of the mixed powder is broken. Accordingly, permeability was exhibited as about 51 which is about 15% lower than the permeability in Example 1 of the present invention. In addition, the core loss characteristics also exhibited the characteristic of 600 mW/cm$^3$ degraded in comparison with the conventional condition since the content of the powder having conducted a crystallization is increased. Thus, it can be seen that desired magnetic permeability and magnetic properties cannot be obtained in the case of the particle size distribution of this alloy powder.

As in Comparative Example 6,in the case that the powder of the small particle size of 5~50 μm is less than 5 wt %, in opposition to Comparative Example 5, the molding density decreases in accordance with the filling property deterioration and the particle size distribution balance of the mixed powder is broken. Therefore, fine cracks may occur on the surface of the core, during molding the core,and a molded body density was implemented to be 79% which is lower than the Example 1. Accordingly, it can be seen that the improvements of both the DC biased characteristics and the core loss characteristics were insignificant.

As described above, the present invention has been described with respect to particularly preferred embodiments. However, the present invention is not limited to the above embodiments, and it is possible for one of ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

The present invention can be applied to a method of manufacturing soft magnetic cores that are obtained by compression-molding nanocrystalline alloy powders having three types of sizes that are obtained by heat treating and grinding Fe-based amorphous ribbons manufactured by RSP, and can be applied to a manufacture of soft magnetic cores for smoothing choke cores of a switching mode power supply (SMPS) having an excellent DC biased characteristic at high current and a very excellent core loss characteristic.

The invention claimed is:

1. A method of manufacturing soft magnetic cores having an excellent high current DC biased characteristic and an excellent core loss characteristic, the method comprising the steps of:

performing a preliminary heat treatment of Fe-based amorphous metal ribbons prepared by using a rapid solidification process (RSP) and nanocrystallizing the preliminarily heat treated Fe-based amorphous metal ribbons;

obtaining alloy powders made of nanocrystalline grains obtained by grinding the metal ribbons;

after classifying the alloy powders, mixing the alloy powders so that a particle size distribution is configured to have a particle size of 75~100 μm with 10~85 wt %, a particle size of 50~75 μm with 10~70 wt %, and a particle size 5~50 μm with 5~20 wt % to thereby obtain mixed powders;

obtaining a core molded body by adding the mixed powders with a binder and compression molding the mixed powders mixed with the binder; and performing an annealing treatment of the core molded body, and coating the annealing treated core molded body with an insulating resin, to thus prepare the soft magnetic cores.

2. The method of claim 1, wherein the binder comprises 0.5 to 3 wt % for the total weight of the mixed powder.

3. The method of claim 1, wherein the preliminary heat treatment is carried out at a temperature in a range of 300~600° C. for 0.2~1 hour.

4. The method of claim 1, wherein the annealing treatment is carried out at a temperature in a range of 400~600° C. for 0.2~1.5 hours in a nitrogen atmosphere.

5. A soft magnetic core having an excellent high current DC biased characteristic and an excellent core loss characteristic, the soft magnetic core comprising:

a core formed by mixing Fe-based nanocrystalline alloy powders with a binder, and compression molding the Fe-based nanocrystalline alloy powders mixed with the binder, wherein the Fe-based nanocrystalline alloy powders are mixed powders obtained by mixing the alloy powders so that a particle size distribution is configured to have a particle size of 75~100 μm with 10~85 wt %, a particle size of 50~75 μm with 10~70 wt %, and a particle size 5~50 μm with 5~20 wt %.

6. The soft magnetic coreof claim 5, wherein the soft magnetic core has a density of 82 to 84%, and a DC biased characteristic (%) is 51 or larger when a measured magnetization intensity is 100 Oe.

* * * * *